US007258069B1

(12) United States Patent
Cotsford

(10) Patent No.: US 7,258,069 B1
(45) Date of Patent: Aug. 21, 2007

(54) LATERALLY ADJUSTABLE NIPPER-CLIPPER ASSEMBLY AND METHOD OF OPERATING A LATERALLY ADJUSTABLE NIPPER-CLIPPER ASSEMBLY

(75) Inventor: Stephen G. Cotsford, Columbia, SC (US)

(73) Assignee: Harsco Technologies Corporation, Fairmont, MN (US)

( * ) Notice: Subject to any disclaimer, the term of this patent is extended or adjusted under 35 U.S.C. 154(b) by 775 days.

(21) Appl. No.: 10/210,385

(22) Filed: Aug. 1, 2002

(51) Int. Cl.
*E01B 27/17* (2006.01)

(52) U.S. Cl. ..... 104/7.1; 104/2

(58) Field of Classification Search ..... 104/17.2, 104/17.1, 7.1, 2; 29/243.56; 173/216; 81/301, 81/347, 364, 486
See application file for complete search history.

(56) References Cited

U.S. PATENT DOCUMENTS 3,610,158 A * 10/1971 Eldemanis ..... 14/17
4,409,901 A * 10/1983 Hark ..... 104/7.2
4,770,103 A * 9/1988 Allmer ..... 104/7.1
5,269,225 A * 12/1993 Bosshart et al. ..... 104/2
5,305,692 A * 4/1994 Madison et al. ..... 104/9
5,398,616 A 3/1995 Eidemanis et al.
5,431,107 A 7/1995 Almaraz et al.
5,465,667 A 11/1995 Hosking et al.
5,584,247 A 12/1996 Almaraz et al.
5,586,502 A 12/1996 Weber
5,927,209 A 7/1999 Cotsford

* cited by examiner

*Primary Examiner*—S. Joseph Morano
(74) *Attorney, Agent, or Firm*—David C. Jenkins; Eckert Seamans Cherin & Mellott, LLC

(57) ABSTRACT

A nipper-clipper assembly for lifting railroad ties and installing clip assembly springs to couple rails to a tie. The ties are disposed below the rails and extending in a lateral direction relative to the longitudinal rails. The nipper-clipper assembly includes a main beam assembly, a right side clipping assembly, a left side rail clipping assembly, a right side nipper assembly having a pad assembly, and a left side nipper assembly having a pad assembly. The nipper assemblies and the clipper assemblies are coupled to the main beam assembly. The right side pad assembly and the side pad assembly are structured to act upon the tie by contacting the lateral ends of the tie.

42 Claims, 5 Drawing Sheets

LATERALLY ADJUSTABLE NIPPER-CLIPPER ASSEMBLY AND METHOD OF OPERATING A LATERALLY ADJUSTABLE NIPPER-CLIPPER ASSEMBLY

BACKGROUND OF THE INVENTION

1. Field of the Invention

This invention relates to a railroad nipper-clipper and, more specifically, to a nipper-clipper that may adjust railroad ties laterally.

2. Background Information

A railroad track includes one or more pairs of longitudinal rails, a plurality of lateral ties, and a ballast bed. The ballast bed is made from large particulate materials, typically gravel. The ties rest on the ballast bed. The pairs of tracks are coupled to the ties. While rails have been traditionally coupled to wooden ties by spikes, modern concrete ties utilize a system of clip assemblies.

Railroad tie clip assemblies include a tie plate fixed to the tie and two springs. The tie plate extends to, or is bifurcated on, both sides of the rail, and the rail is disposed therebetween. Two springs are coupled to the tie plate, one disposed on each side of the rail. The springs have an upper U-shaped portion and two lower fingers that double back under the U-shaped portion. The spring biases the U-shaped portion towards the fingers. The fingers engage the tie plate and are horizontally slidable thereon. The springs move from an installed position where the U-shaped portion engages the rail to an uninstalled position where the U-shaped portion does not engage the rail. Thus, the U-shaped portion biases the rail against the tie plate, and, by extension against the tie.

A clipping machine, hereinafter a "clipper," is a device structured to couple the rail to the tie by moving the spring from the uninstalled position to the installed position. Clippers are known in the prior art. A typical operation for a clipper occurs on a newly laid track, or a restored track, wherein the ballast bed has been laid, the ties installed thereon, and the rails disposed between the plurality of clip assemblies on the ties. So long as the rails are aligned in the tie plates, the clipper need only to advance along the track installing clips. If, however, the ballast bed is not smooth, certain ties may be lower than adjacent ties. In this situation the ties may have to be lifted in order to align the brackets with the rails. The act of lifting a tie to be in contact with the lower side of a rail is called "nipping." The device structured to lift the tie is called a "nipper." The nipping and clipping operations must be performed at the same time. Thus, the device that combines these features is a "nipper-clipper."

Prior art nippers utilized one or more, typically two, clamps that gripped the forward and aft sides of a tie, or, extended over the forward and aft sides of the tie while lifting the tie from the underside. While the prior art nippers were effective in lifting the tie into contact with the underside of the rail, the prior art nippers could not laterally adjust the tie. That is, if the tie was laterally off center, as compared to the rails or adjacent ties, the prior art nippers had no means for laterally repositioning or adjusting the tie so that the rail would be centrally over the tie plate.

There is, therefore, a need for a nipper-clipper assembly structured to laterally adjust a tie.

There is a further need for a nipper-clipper assembly that automatically laterally adjusts a tie.

There is a further need for a mobile nipper-clipper vehicle structured to travel along a track laterally adjusting ties and installing clip assembly springs.

SUMMARY OF THE INVENTION

These needs, and others, are met by the invention which provides a nipper assembly structured to grip a tie by the lateral ends as opposed to the forward and aft sides or the bottom surface. The nipper assembly is further structured to automatically center the tie as the tie is being lifted.

The nipper assembly includes a main beam assembly extending in a lateral direction, a right and left side vertical arm assembly and a right and left side lateral arm assembly. The vertical arm assemblies and the lateral arm assemblies are structured to cooperatively act in a pincer-like manner to hold and lift a tie. The vertical arm assemblies each include a first piston, a first member, a second member, and a pad assembly. The first member is coupled to the main beam assembly. The second member is disposed at the distal end of the first member and is freely pivotable in a lateral direction. The pad assembly is coupled to the second member and is structured to contact the tie. The lateral arm assemblies include a lateral piston and lateral rods which are mounted on pivotable rocker arms and, therefore, are not fixed to the main beam assembly. The lateral rods are further coupled to the second members and act on the second members to move the pad assemblies in a pincer-like manner so that the pad assemblies contact the lateral ends of the tie. When the tie is held by the pad assemblies, the vertical piston actuates to lift the tie. Because the vertical arm second members, the lateral piston and the lateral rods are free to move laterally, as the tie is being lifted gravity will cause the tie to center itself laterally below the rails. Alternatively, a piston may be structured to act on the lateral arm assembly to actively move the tie laterally.

The nipper assembly can be attached to a rail vehicle that also supports a clipper assembly. Accordingly, the nipper-clipper assembly is structured to nip and laterally adjust railroad ties prior to clipping.

It is an object of this invention to provide a nipper-clipper assembly structured to laterally adjust a tie.

It is a further object of this invention to provide a nipper-clipper assembly that can laterally adjust a tie automatically.

It is a further object of this invention to provide a mobile nipper-clipper vehicle structured to travel along a track laterally adjusting ties and installing clip assembly springs.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As used herein "longitudinal" shall mean generally parallel to the direction of the railroad rails 4, 4A.

As used herein "lateral" shall mean generally perpendicular to the direction of the railroad rails 4, 4A.

As used herein the terms "left" and "right" when referring to the rails or a side of the vehicle 10 shall mean the left and right rails as seen by the driver of the vehicle 10 while facing forward.

As used herein "piston" shall mean a device having a cylinder defining a pressure chamber and a rod disposed within the pressure chamber. The pressure chamber may be filled with either a hydraulic or pneumatic fluid. By increasing or decreasing the fluid pressure in the pressure chamber, the rod moves out of or into the pressure chamber thereby increasing or decreasing the length of the piston.

As used herein "held" when referring to the tie 2 means that the tie is grasped, lifted or in any other way supported by the nipper-clipper assembly 30.

Figure 1:
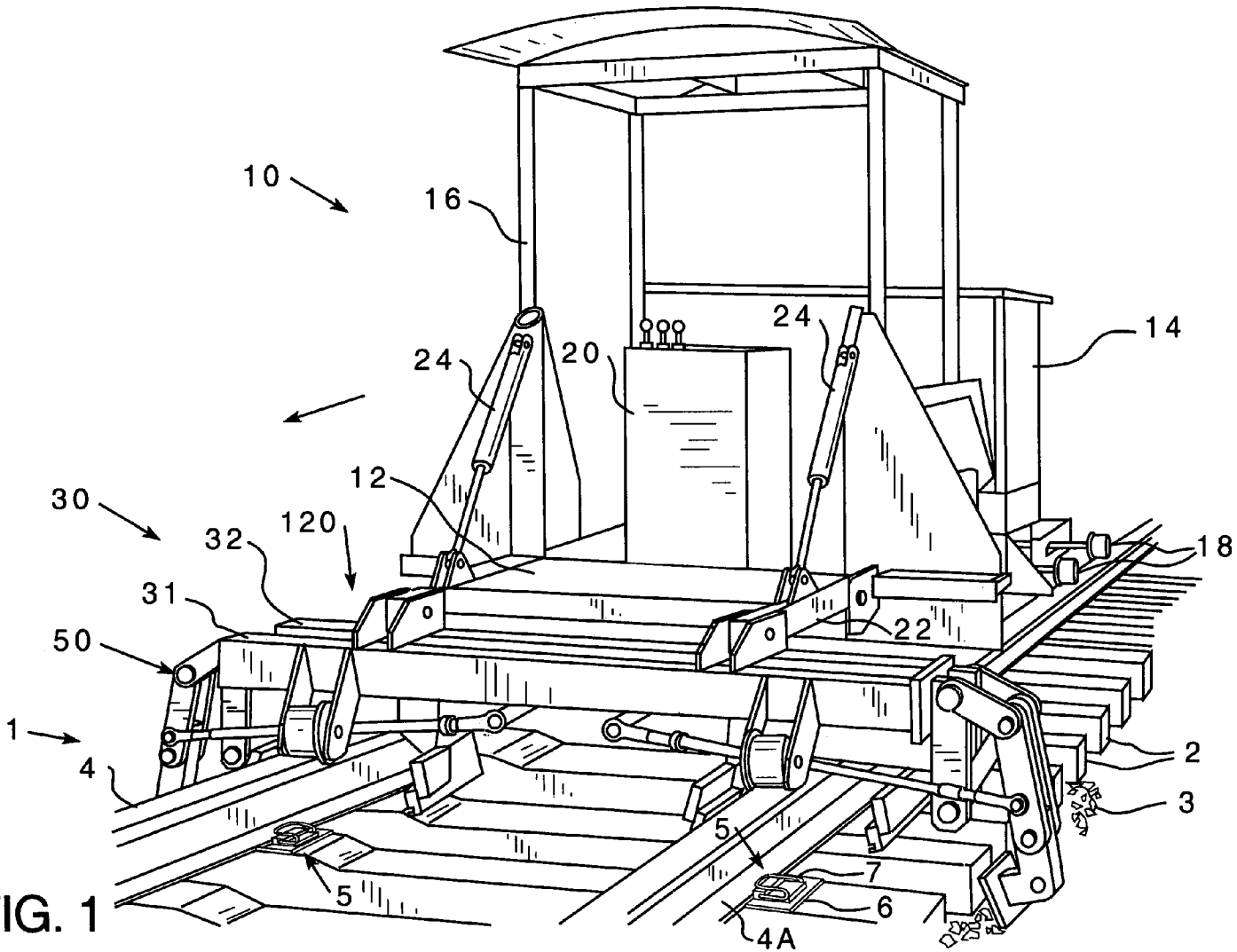
FIG. 1 is an isometric view of a railroad vehicle having a nipper-clipper assembly.
Figure 2:
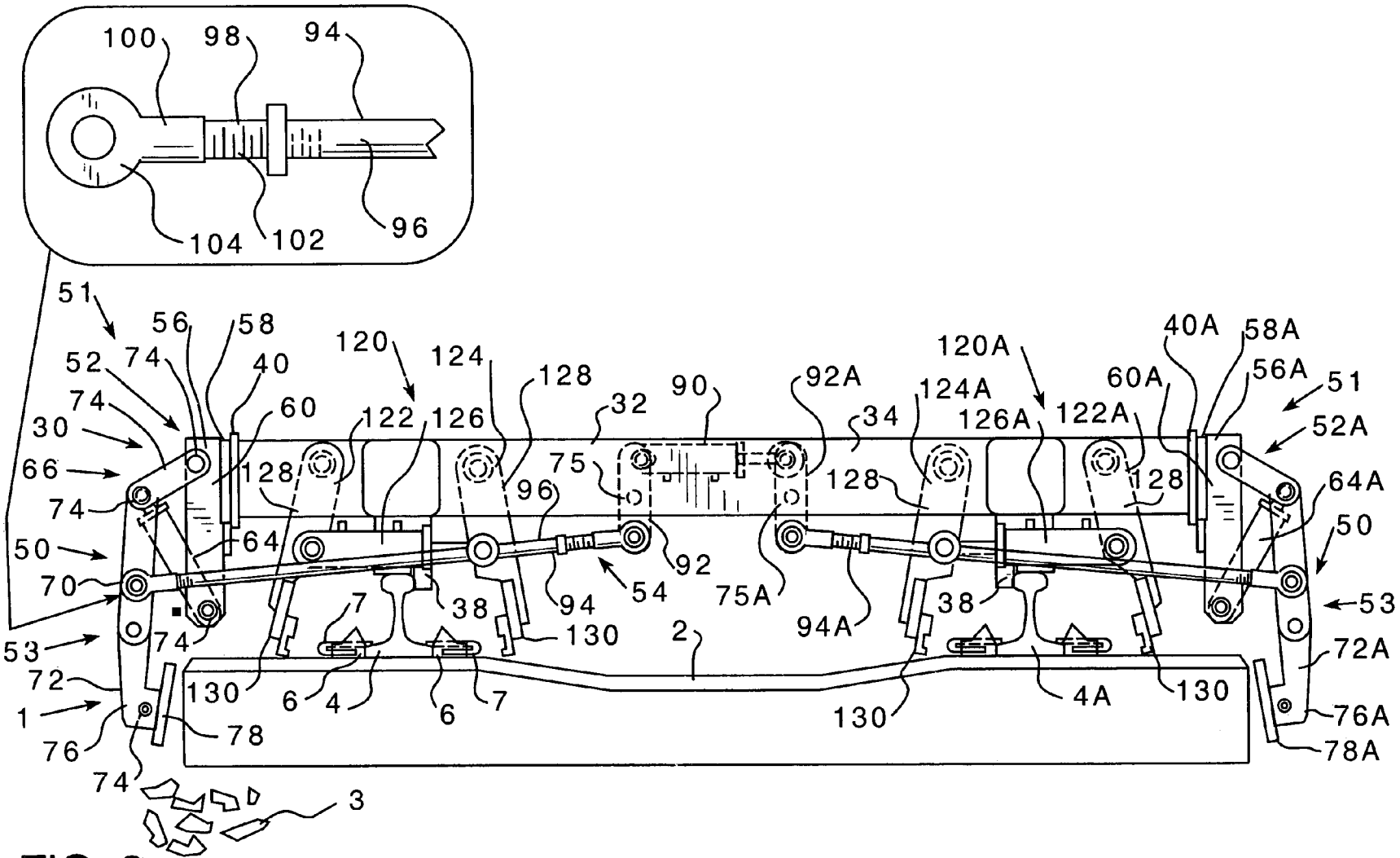
FIG. 2 is a front view of the nipper-clipper assembly.
Figure 3:
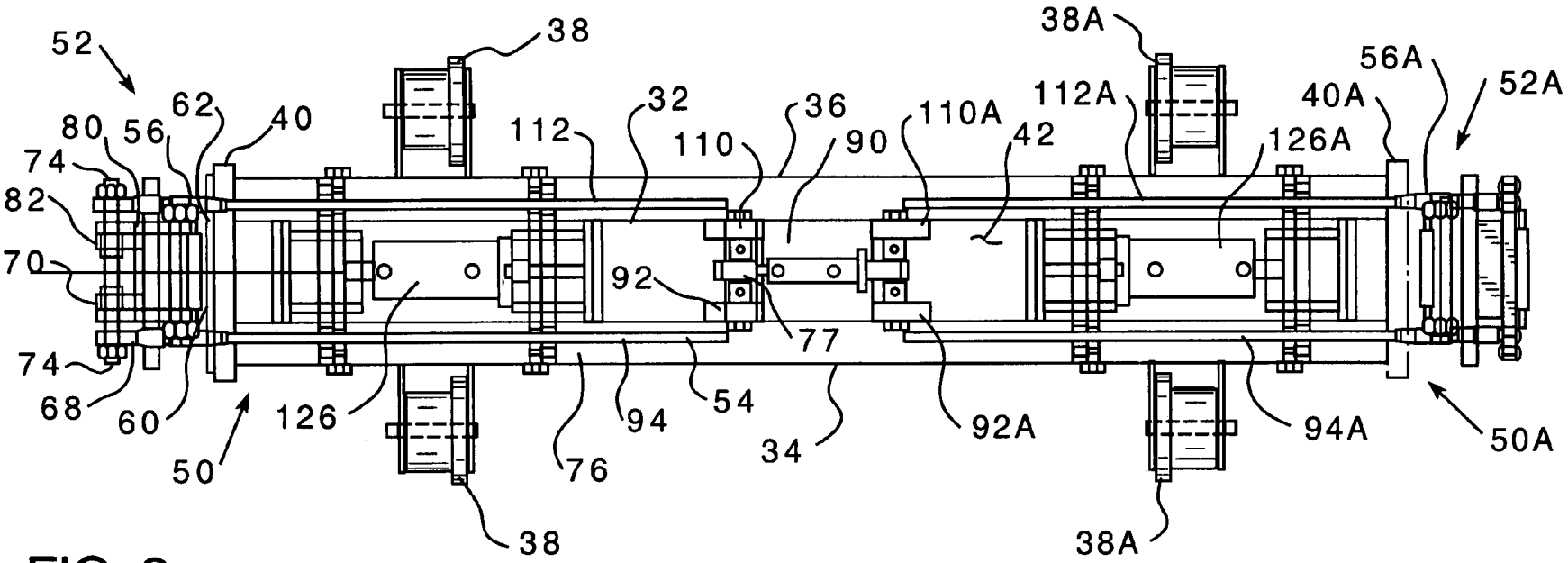
FIG. 3 is a top view of the nipper-clipper assembly.
Figure 4:
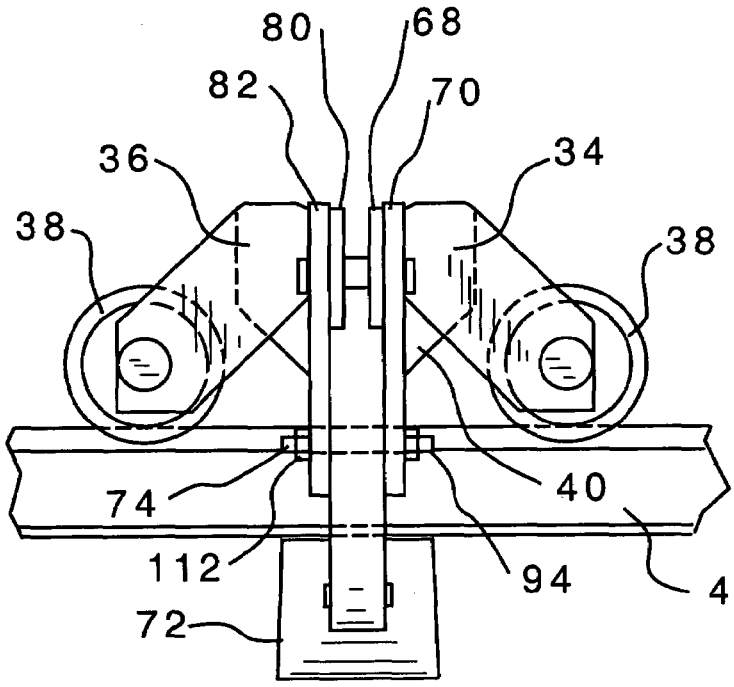
FIG. 4 is a partial side view of the nipper clipper assembly.

A mobile nipper-clipper vehicle 10 is shown in FIG. 1. The vehicle 10 is structured to travel on a railroad track 1. As is well known, the railroad track 1 includes a plurality of ties 2 disposed on or within a gravel-like ballast bed 3. One or more pairs of rails 4, 4A are disposed on top of each tie 2. The rails 4, 4A are coupled to the ties 2 by clip assembly 5. The clip assembly includes a tie plate 6 and a removable spring 7. The tie plate 6 is coupled to the tie 2. When the spring 7 is installed, the spring 7 engages both the rail 4 and the tie plate 6. The ties 2 extend laterally under the rails 4, 4A. The direction of travel of the vehicle 10 along the rails 4, 4A is indicated by the arrow.

The vehicle 10 includes a nipper-clipper assembly 30 which includes a plurality of components such as a nipper assembly 50 and a clipper assembly 120, detailed below. Typically, there will be a component located over each rail 4, 4A. These components are typically mirror images of each other. Thus, except were noted below, the following description will be addressed to the right side of the nipper-clipper assembly 30. That is, the description will generally address the components disposed above the right rail 4. It will be understood that similar, mirror image components are also disposed above the left rail 4A. Like components disposed above the left rail 4A will be indicated using a like reference number followed by the letter "A." The components may also be referred to as "right side" or "left side" components. Thus, for example, there is a right side clipper assembly 120 above the right rail 4 and a left side clipper assembly 120A above the left rail 4A.

The vehicle 10 is structured to travel on the railroad track 1 and includes a frame 12, an engine 14, a cab 16, a plurality of rail wheels 18, and a control panel 20. The engine 14 and rail wheels 18, cab 16 and control panel 20 are coupled to the frame 12. The engine 14 is operably coupled to one or more of the rail wheels 18 thereby creating drive wheels that will move the vehicle along the railroad track 1. The control panel 20 is disposed at the front end of the cab 16. The vehicle further includes a nipper-clipper assembly 30 which is coupled to the frame 12 in front of the cab 16. The nipper-clipper assembly 30 is coupled to the frame 12 by a mounting bracket 22. The mounting bracket 22 is pivotally coupled to the frame 12. The vehicle 10 further includes a lifting means such as one or more lifting pistons 24 for lifting the nipper-clipper assembly 30. The lifting pistons 24 are attached to the frame 12 and the mounting bracket 22 and are structured to lift the mounting bracket 22 and nipper-clipper assembly 30 away from the rails 4, 4A. Thus, the nipper-clipper assembly 30 may be moved from a first, lower position wherein the nipper-clipper assembly 30 is adjacent to the rails 4, 4A, to a second, upper position wherein the nipper-clipper assembly 30 is spaced from the rails 4, 4A. The control panel 20 includes controls for operating the engine 14, the lifting pistons 24, and the nipper-clipper assembly 30.

The nipper-clipper assembly 30 includes a mounting device 31 that is structured to be coupled to the vehicle 10. Preferably the mounting device 31 is a main beam assembly 32 that extends laterally across, and beyond, both rails 4, 4A. The main beam assembly 32 includes a first lateral beam 34, a second lateral beam 36 and one or more rail wheels 38 disposed above each rail 4, 4A. The first and second lateral beams 34, 36 are maintained in a spaced relation by endplates 40, 40A so that there is a gap 42 therebetween. Each side, that is the left and right sides, of the main beam assembly 32 supports a set of rail wheels 38, a nipper assembly 50 and a clipper assembly 120. The main beam assembly rail wheels 38 are spaced to engage the rails 4, 4A and support the nipper-clipper assembly 30 when the nipper-clipper assembly 30 is in the first position. Alternatively, the mounting device 31 may be a frame assembly, not shown, such as members extending longitudinally from the vehicle 10.

As noted above, the components on one side of the main beam assembly 32 are mirrored on the other side of the main beam assembly 32. The nipper assembly 50 includes a vertical lifting device 51 that is structured to lift the ties 2, such as vertical arm assembly 52, and a lateral movement device 53 that is structured to move the ties 2 laterally, such as lateral arm assembly 54. Preferably, the lateral movement of the tie 2 occurs due to the force of gravity. That is, as described below, the lateral movement device 53 is not rigidly coupled to the main beam assembly 32 and, as such, may move freely in a lateral direction. Thus, gravity will cause the tie 2 to shift into a laterally neutral position wherein the tie plates 6 are centered under the rails 4, 4A. The lateral movement device 53 may also include a device for actively shifting the tie 2 in a lateral direction, as described hereinafter.

The vertical arm assembly 52 includes a mounting assembly 56 having a base plate 58, a first elongated vertical member 60 and a second elongated vertical member 62, a lifting device, such as a vertical piston 64, and an articulated arm 66 having a first elongated member 68, a second elongated member 70 and a pad assembly 72. The vertical piston 64 extends generally vertically, but is not absolutely vertical. The base plate is coupled to the main beam assembly endplate 40. The first and second vertical members 60, 62 are coupled at the vertical member upper ends to the base plate 58 and extend toward the rail 4. The vertical members 60, 62 are spaced apart. The vertical piston 64 is rotatably coupled to the vertical members by a horizontal pivot pin 74 which extends in a longitudinal direction through the lower ends of the vertical members 60, 62. The vertical piston 64 is, generally, disposed between the two vertical members 60, 62.

The first member 68, which is preferably shorter than the second member 70, is rotatably coupled to the upper end of the first vertical member 60 by a pivot pin 74 that extends horizontally in a longitudinal direction. Thus, the first member 68 extends in a generally horizontal and lateral direction, but may pivot above or below a precise horizontal direction.

The distal end of the first member 68, that is, the end opposite the end attached to the first vertical member 60, includes another pivot pin 74 that extends horizontally in a longitudinal direction. The end of the vertical piston 64 opposite the end coupled to the first vertical member 60 is rotatably coupled to the pivot pin 74 disposed at the distal end of the first member 68. Additionally, the second member 70 is coupled at one end to the pivot pin 74 disposed on the first member 68 and extends downward toward the ballast bed 3. The second member 70 has a sufficient length so that the distal end of the second member 70 is adjacent to the upper surface of the tie 2. The second member 70 is loosely coupled to the pivot pin 74 at the distal end of the first member 68 so that the second member 70 may pivot freely.

Figure 5:
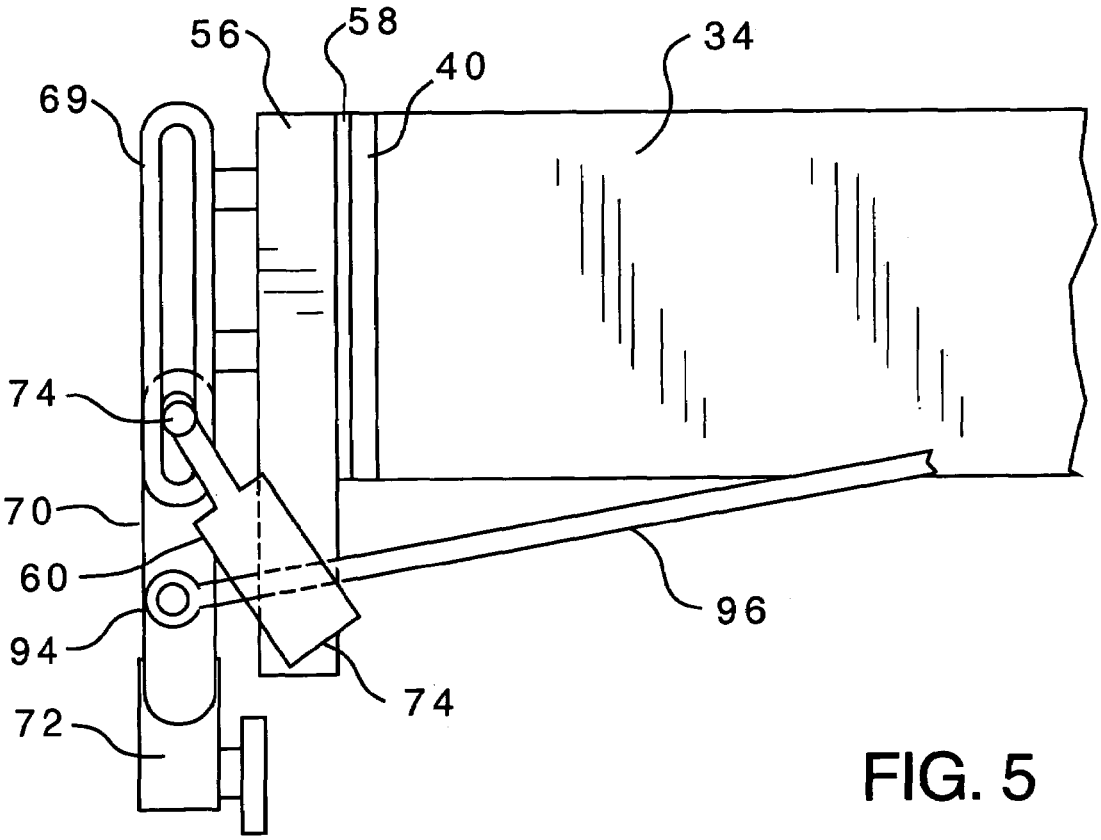
FIG. 5 is a front detail view of an alternate vertical arm assembly.

The articulated arm 66 may be constructed by various structures so long as the second member 70 is free to pivot laterally and move vertically. For example, as shown in FIG. 5, an alternate first member 69 is an elongated member having a slot. The slot extends in a generally vertical direction. A pivot pin 74 is slidably disposed in the slot. As before, the vertical piston 64 and the second member 70 are coupled to the pivot pin 74. The vertical piston 64 is structured to move the pivot pin 74 within the slot. Therefore, the second member 70 is also moved in a generally vertical direction. The second member 70 is free to pivot laterally on the pivot pin 74. Thus, the second member 70 is free to pivot laterally and move vertically.

The pad assembly 72 is coupled to the distal end of the second member 70. The pad assembly 72 includes a mounting extension 76, which is coupled to the second member 70, and a pad plate 78 pivotally coupled thereto. The face of the pad plate 78 extends in a generally vertical and longitudinal direction. The pad plate 78 is coupled to the mounting extension 76 by another pivot pin 74 that extends horizontally in a longitudinal direction.

Additional support in the articulated arm 66 may be provided by a third member 80 and a fourth member 82. The third member 80 is substantially similar to the first member 68, but is pivotally connected to the second vertical member 62 and to the pivot pin 74 located at the distal end of the first member 69. The fourth member 82 is substantially similar to the second member 70 and is pivotally connected to the pivot pin 74 located at the distal end of the first member 69, but is spaced from the second member 70. As such, the pad assembly 72 may be disposed between, and coupled to both, the second member 70 and the fourth member 82.

In this configuration, the vertical arm assembly 52 may move between two positions, a first, upper position and a second, lower position. In the first position, the vertical piston 64 is in the expanded position and the distal end of the first member 68, at the pivot pin 74 where the vertical piston 64 is coupled to the first member 68, is pivoted so that the distal end of the first member 68 is at a greater distance from the ballast bed 3 than when the vertical arm assembly 52 is in the second position. Thus, the second member 70 is also at a greater distance from the ballast bed 3 than when the vertical arm assembly 52 is in the second position. In the second position, the vertical piston 64 is in the contracted position and the distal end of the first member 68, at the pivot pin 74 where the vertical piston 64 is coupled to the first member 68, is pivoted so that it is at a lesser distance from the ballast bed 3 than when the vertical arm assembly 52 is in the first position. Thus, the second member 70 is also at a lesser distance from the ballast bed 3 than when the vertical arm assembly 52 is in the first position. In an alternate configuration (not shown) the vertical piston 64 may be coupled to the main beam assembly 32 at a location above the first member 68. In this configuration, the condition of the piston, i.e. expanded or contracted relative to the positions will be reversed.

The lateral arm assembly 54 includes a lateral piston 90, an elongated rocker arm 92 and a lateral rod assembly 94. The lateral rod assembly 94 includes an lateral elongated rod 96 having a threaded cavity 98 on each end and two connectors 100, each having a threaded rod 102 and a plate 104 having an opening. The threads within each threaded cavity 98 are tapped in opposite directions. Each connector 100 is coupled to the rod 96 with the threaded rod 102 engaging one threaded cavity 98. Thus, the length of the lateral rod assembly may be adjusted by rotating the rod. That is, the connectors 100 are coupled to other structures and cannot be rotated axially. By rotating the elongated rod 96, the ends of the rod 96, that is the threaded rods 102, will move into, or out of, the threaded cavities 98.

The rocker arm 92 is disposed on a rocker arm pivot rod 75 that is disposed on the first lateral beam 34 and which extends into the gap between the first lateral beam 34 and second lateral beam 36. The rocker arm pivot rod 75 extends horizontally in the longitudinal direction and is disposed near, but spaced from, the lateral centerline of the first lateral beam 34 and second lateral beam 36. The rocker arm 92 is pivotally disposed on the rocker arm pivot rod 75 and extends, generally, in a vertical direction. One end of the lateral piston 90 is attached to one end of the rocker arm 92. Preferably, the lateral piston 90 is attached to the upper end of the rocker arm 92. The other end of the lateral piston 90, that is, the end of the lateral piston 90 not attached to the right side rocker arm, 92 is attached to the left side rocker arm 92A. Thus, unlike other components, the right side lateral arm assembly 54 and the left side lateral arm assembly 54A share the lateral piston 90. That is, there is only a single lateral piston 90. Additionally, the lateral piston 90 "floats." That is, the lateral piston 90 is not rigidly attached to the main beam assembly 32 and may move laterally relative to the main beam assembly 32, so long as the lateral piston 90 is maintained in a generally horizontal and lateral orientation. As shown, the lateral piston 90 is coupled to main beam assembly 32 by the pivotable right side rocker arm 92 and left side rocker arm 92A, however, the lateral piston 90 may be floatably coupled to the main beam assembly 32 in more than one manner. For example, the ends of lateral piston 90 may be coupled directly to the right side and left side lateral rods 96, 96A while the piston body is pivotally coupled to an two or more elongated members (not shown) that are further pivotally coupled to the main beam assembly 32. Alternately, the lateral piston 90 could be coupled to a lateral track (not shown) or disposed within a lateral tube (not shown) having slots for the lateral rod 96, 96A or any other structure which allows the lateral piston 90 to move laterally while maintaining a generally horizontal orientation.

The end of the rocker arm 92 not coupled to the lateral piston 90 is coupled to one connector 100 on the lateral rod assembly 94. The rocker arm 92 is pivotally coupled to the connector 100 by a pivot pin 74, which is horizontal and extends longitudinally, that passes through the plate 104 opening and through the rocker arm 92. The lateral rod assembly 94 extends toward the lower end of the articulated arm assembly 66. The connector 100 that is not coupled to the rocker arm 92 is pivotally coupled to the medial portion of the second member 70.

As with the vertical arm assembly 52, the strength of the lateral arm assembly 54 may be improved by the addition of a second rocker arm 110 and a lateral rod assembly 112. The second lateral rod assembly has the same components as the lateral rod assembly 94. The second rocker arm 110 is disposed on a second rocker arm pivot rod 77 that is disposed on the second lateral beam 36 and which extends into the gap between the first lateral beam 34 and second lateral beam 36. The second rocker arm pivot rod 77 is aligned with the rocker arm pivot rod 75 and extends horizontally in the longitudinal direction and is disposed near, but spaced from, the lateral centerline of the first lateral beam 34 and second lateral beam 36. The second rocker arm 110 is pivotally disposed on the second rocker arm pivot rod 77 and extends, generally, in a vertical direction. One end of the lateral piston 90 is attached to one end of the second rocker arm 110. Preferably, the lateral piston 90 is attached to the upper end of the second rocker arm 110. The end of the second rocker arm 110 not coupled to the lateral piston 90 is coupled to one connector 100 on the second lateral rod assembly 112. The second rocker arm 110 is pivotally coupled to the connector 100 by a pivot rod 74, which is horizontal and extends longitudinally, that passes through the plate 104 opening and through the second rocker arm 110. The second lateral rod assembly 112 extends toward the lower end of the articulated arm assembly 66. The connector 100 that is not coupled to the second rocker arm 110 is pivotally coupled to the medial portion of the fourth member 82.

In this configuration, and because the vertical arm assembly second member 70 pivots loosely at the distal end of the first member 68, actuation of the lateral piston 90 causes the second members 70, 70A to move between a first, open position where the pad assembly 72 is spaced from the tie 2, and a second closed position where the pad assembly 72 contacts the tie 2. That is, when the lateral piston 90 is in the contracted position, the end of the rocker arm 92 not attached to the lateral piston 90 is closer to the end plate 40 than when the lateral piston 90 is in the expanded position. As such, the second member 70 is pivoted away from the tie 2. The second member 70, generally, pivots about the pivot pin 74 at the distal end of the first member 68. Conversely, when the lateral piston 90 is in the extended position, the end of the rocker arm 92 not attached to the lateral piston 90 is further from the end plate 40 than when the lateral piston 90 is in the contracted position. As such, the second member 70 is pivoted toward the tie 2 until the pad assembly 72 contacts the tie 2.

The clipper assembly 120 includes a first pincer arm assembly 122, a second pincer arm assembly 124 and a pincer piston 126. The first and second pincer arm assemblies 122, 124 each include an elongated arm body 128 and a pincer pad 130. The first pincer arm assembly 122 and second pincer arm assembly 124 are each pivotally coupled to the main beam assembly 32 by pivot pins 74 that extend horizontally in a longitudinal direction. Preferably, the pivot pins 74 supporting the first and second pincer arm assemblies 122, 124 extend between the first lateral beam 34 and the second lateral beam 36. As such, the first and second pincer arm assemblies 122, 124 are generally disposed in the gap 42 between the first lateral beam 34 and the second lateral beam 36. The first pincer arm assembly 122 is disposed on the main beam assembly 32 at a location on the outer side of the rail 4. The second pincer arm assembly 124 is disposed on the main beam assembly 32 at a location on the inner side of the rail 4. The pincer piston 126 extends between, and is pivotally coupled to, a medial portion of both the first and second pincer arm assemblies 122, 124. Each pincer pad 130 is disposed at the distal end of an arm body 128. The combined vertical length or the arm body 128 and the pincer pad 130 is such that the pincer pad 130 is disposed adjacent to the tie plate 6 and spring 7. As such, the distal ends of the first and second pincer arm assemblies 122, 124 are structured to swing together in a pincer-like motion. The initial position for the clipper assembly 120 is with the pincer piston 126 in an extended position. Thus, the pincer arm assemblies 122, 124 are in a first, open position. When the pincer piston 126 is actuated, the pincer arm assemblies 122, 124 are drawn together in a pincer-like manner to a second, closed position. The pincer arm assemblies 122, 124 are structured to contact the springs 7 on either side of the rail 4 and do not contact each other in the second, closed position.

Figure 6:
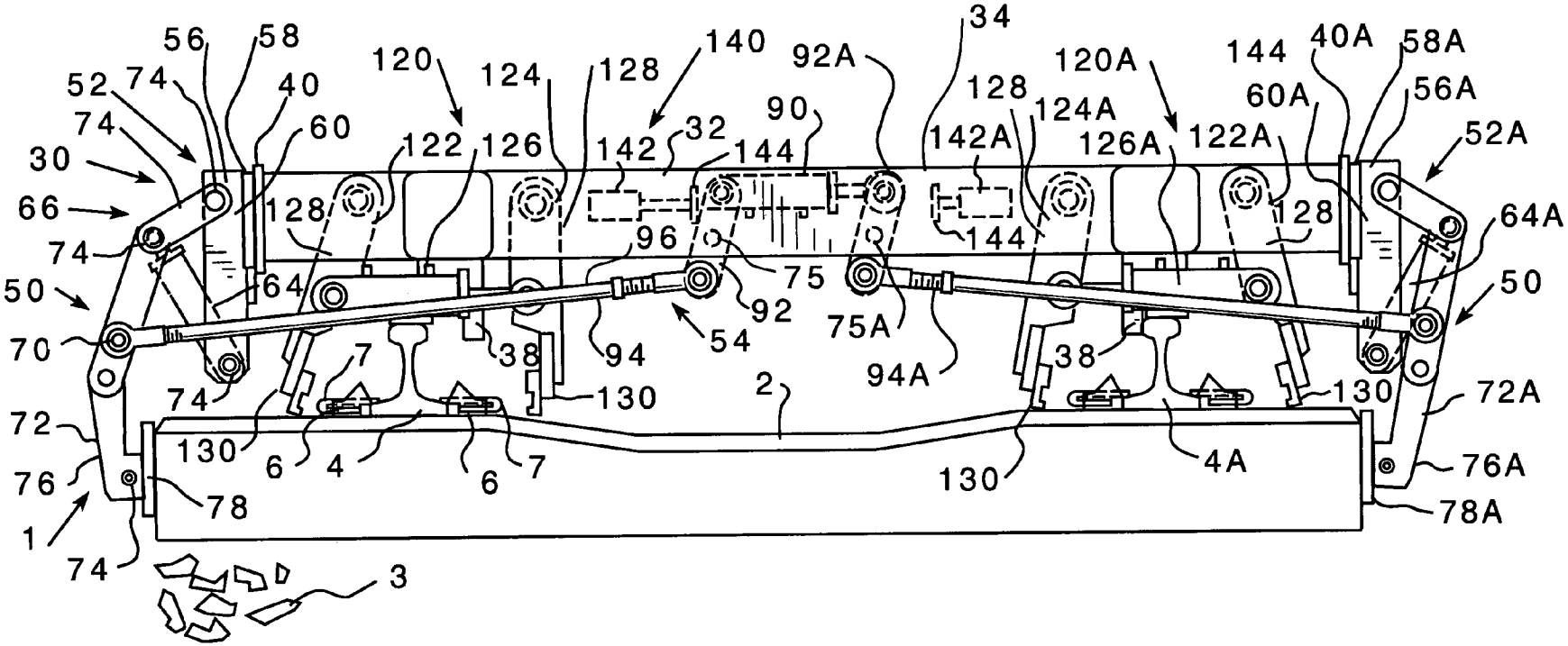
FIG. 6 is a front view of an alternate embodiment.

In an alternate embodiment, shown in FIG. 6, the lateral arm assembly 54 also includes a lateral movement assembly 140 structured to actively move a tie 2, once it is lifted by the vertical arm assembly 52, in a lateral direction. The lateral movement assembly 140 include at least two laterally oriented stand off pistons 142, 142A. The stand off pistons 142, 142A are each coupled to the main beam assembly 32. Each stand off piston 142, 142A has a contact end 144 that is structured to engage, but not be attached to, a rocker arm 92, 92A. Each stand off piston 142, 142A is disposed on the outer side of a rocker arm 92, 92A. Preferably, each stand off piston 142, 142A is disposed adjacent to the either end of the rocker arm 92 and are never aligned with the rocker arm pivot rod 75. In the retracted position, each stand off piston contact end 144 is spaced from the associated rocker arm 92, 92A. When either stand off piston 142, 142A is actuated, the contact end 144 will extend and engage the associated rocker arm 92, 92A causing the rocker arm 92, 92A to pivot about the rocker arm pivot rod 75, 75A. This motion is further translated to the lateral arm assemblies 54, 54A thereby causing the lateral arm assemblies 54, 54A to be shifted laterally. Only one stand off piston 142, 142A will be actuated at one time. One stand off piston 142 is structured to move the tie 2 to the right side, and the other stand off piston 142A is structured to move the tie 2 to the left side. When both stand off pistons 142, 142A are in the retracted position, the rocker arms 92, 92A pivot freely about the rocker arm pivot rods 75, 75A.

The mobile nipper-clipper vehicle 10 operates as follows. The vehicle 10 is disposed on a railroad track 1 wherein the rails 4, 4A are not coupled to every tie 2 by the springs 7. The unengaged springs 7 are coupled to the tie plates 6 but spaced from the rails 4, 4A. One or more ties 2 may be misaligned with the rails 4, 4A by being lower than the rails 4, 4A and/or laterally displaced so that the rails 4, 4A do not lie immediately above the tie plate 6. The vehicle 10 advances along the railroad track with either the nipper-clipper assembly 30 raised by the lifting pistons 24 to the second, upper position, or with the vertical arm assembly second members 70, 70A in the first open position. Typically, if the vehicle 10 is required to travel a substantial distance, the nipper-clipper assembly 30 will be raised by the lifting pistons 24. Conversely, as the vehicle 10 moves from tie 2 to tie 2 installing springs 7, the nipper-clipper assembly 30 is maintained in the first, lower position by the lifting pistons 24 and the second members 70, 70A in the first, open position.

Once the nipper-clipper assembly 20 is disposed over a misaligned tie 2 the nipping operation occurs. To be disposed over a misaligned tie 2, the tie 2 is disposed generally below the gap 42 between the first and second lateral beams 34, 36. When the nipper-clipper assembly 30 is disposed over the misaligned tie 2, the vehicle 10 stops advancing along the railroad track 1. If the nipper-clipper assembly 30 is in the second, upper position, the lifting pistons 24 are actuated to lower the nipper-clipper assembly 30 into the first, lower position. If the vertical arm assemblies 52, 52A are in the first, upper position, the vertical arm assemblies 52, 52A are moved into the second, lower position. With the nipper-clipper assembly 30 in the first, lower position, and the vertical arm assemblies 52, 52A in the second, lower position, and the second members 70, 70A in the first, open position, the pad assembly 72 is disposed adjacent to, but spaced from, each lateral end of the tie 2. At this point, the lateral piston 90 is actuated causing the rocker arm 92 to pivot about the rocker arm pivot rod 75 thereby moving the vertical arm assembly second member 70 from the first, open position, to the second, closed position. That is, as the lateral piston 90 is actuated, the second member 70 is drawn toward the tie 2 until the pad assembly 72 contacts and applies pressure to the right lateral end of the tie 2. The pressure applied by the pad assembly 72 is between about 650 psi to 2600 psi, and preferably about 750 psi. As detailed above, the lateral piston 90 is also coupled to the left side rocker arm 92A which is further coupled to the left side second member 70A. Accordingly, the left side pad assembly 72A is drawn against the left lateral end of the tie 2. Thus, the lateral ends of the tie 2 are held by the two pad assemblies 72, 72A.

Once the tie is held by the pad assemblies 72, 72A the vertical piston 64 is actuated to move the vertical arm assemblies 52, 52A from the second, lower position to the first, upper position. By raising the vertical arm assemblies 52, 52A, the two pad assemblies 72, 72A, and therefore the tie 2, are also raised. Once the tie 2 is lifted off of the ballast bed 3, gravity will cause the tie to automatically center under the rails 4, 4A. That is, because the two second members 70, 70A are free to pivot about the pivot pin 74 at the distal end of the first member 68, and because the lateral piston 90 is a floating piston, there are no mechanical forces holding the tie 2 in the laterally offset position. Therefore, once the tie 2 is lifted off of the ballast bed 3, the tie 2 is free to move laterally and gravity will cause the tie 2 to automatically center itself under the rails 4, 4A. Once the tie 2 is laterally centered under the rails 4, 4A, the vertical pistons 64, 64A are further extended so that the tie 2 is drawn against the bottom of the rails 4, 4A.

If the tie does not become automatically centered, and if the lateral arm assembly 54 includes the lateral movement assembly 140, the tie 2 may be actively shifted laterally. That is, if the tie is not centered automatically, either stand off piston 142, 142A may be actuated thereby causing the lateral arm assemblies 54, 54A to be laterally sifted, as described above, and therefore moving the tie 2 laterally. The tie 2 is shifted laterally until the tie plates 6 are aligned with the rails 4, 4A. Once the tie 2 is laterally centered under the rails 4, 4A, the vertical pistons 64, 64A are further extended so that the tie 2 is drawn against the bottom of the rails 4, 4A. At this point the nipping operation is complete.

Once the tie 2 has been nipped, the clipping procedure is preformed by the clipper assemblies 120, 120A. The pincer pistons 126, 126A are actuated causing the pincer arm assemblies 122, 124, 122A, 124A to be drawn together in a pincer-like manner to the second, closed position. During this motion each pincer pad 130, 130A will contact a spring 7 and move the spring 7 from a position adjacent to the rail 4, 4A to a position where each spring engages a tie plate 6 and a rail 4, 4A. Once the clipping operation is complete, the pincer pistons 126, 126A are actuated to cause the pincer arm assemblies 122, 124, 122A, 124A to move to the first, open position. Then the lateral piston 90 is actuated to cause each vertical member 70, 70A to return to the first open position, thereby releasing the tie 2. At this point the operation is complete and the vehicle 10 move to the next tie to be clipped or nipped and clipped.

While specific embodiments of the invention have been described in detail, it will be appreciated by those skilled in the art that various modifications and alternatives to those details could be developed in light of the overall teachings of the disclosure. For example, the pad assemblies 72 have been described as having flat plate 78. The pad assembly may include an L-shaped plate that hooks under the tie 2 as well as applying lateral pressure. Accordingly, the particular arrangements disclosed are meant to be illustrative only and not limiting as to the scope of invention which is to be given the full breadth of the claims appended and any and all equivalents thereof.

The invention claimed is:

1. A nipper-clipper assembly for lifting railroad ties and applying clips and structured to be coupled to a rail vehicle, said railroad ties disposed below longitudinal railroad rails and extending in a lateral direction relative to the longitudinal rails, said nipper-clipper assembly comprising:

a mounting device;

a nipper assembly that is structured to lift said ties and move said ties laterally and which includes a vertical lifting device that is structured to lift said ties and a lateral movement device that is structured to move said ties laterally; and one or more clipping assemblies.

2. The nipper-clipper assembly of claim 1, wherein said lateral movement device is floatably coupled to said mounting device.

3. The nipper-clipper assembly of claim 1, wherein said vertical lifting device is structured to contact the lateral ends of said tie.

4. A nipper-clipper assembly for lifting railroad ties and applying clips and structured to be coupled to a rail vehicle, said railroad ties disposed below longitudinal railroad rails and extending in a lateral direction relative to the longitudinal rails, said nipper-clipper assembly comprising:

a main beam assembly;

a right side clipping assembly coupled to said main beam assembly;

a left side clipping assembly coupled to said main beam assembly;

a right side nipper assembly having a pad assembly coupled to said main beam assembly;

a left side nipper assembly having a pad assembly coupled to said main beam assembly; and said right side pad assembly and said left side pad assembly structured to act upon said tie by contacting the lateral ends of said tie.

5. The nipper-clipper assembly of claim 4, wherein said right side nipper assembly and left side nipper assembly are structured to move said tie laterally.

6. The nipper-clipper of claim 5, wherein said right side nipper assembly and left side nipper assembly are structured to cooperate in a pincer-like movement.

7. The nipper-clipper assembly of claim 6, wherein said nipper assembly includes:

a right side vertical arm assembly having an articulated arm that is pivotally coupled to said main beam assembly and structured to move between a first upper position and a second lower position;

a left side vertical arm assembly having an articulated arm that is pivotally coupled to said main beam assembly and structured to move between a first upper position and a second lower position;

a right side lateral arm assembly structured to move between a first, open position and a second closed position; and a left side lateral arm assembly structured to move between a first, open position and a second closed position.

8. The nipper-clipper assembly of claim 7, wherein:
said right side lateral arm assembly and said left side lateral arm assembly share a lateral piston; and
said lateral piston is floatably coupled to said main beam assembly.

9. The nipper-clipper assembly of claim 8, wherein:
said nipper assembly includes one or more rocker arms;
said one or more rocker arms pivotally coupled to said main beam assembly; and
said lateral piston is pivotally coupled to said one or more rocker arms.

10. The nipper-clipper assembly of claim 8, wherein:
said right side lateral arm assembly includes at least one rocker arm, and at least one lateral rod assembly;
said left side lateral arm assembly includes at least one rocker arm, and at least one lateral rod assembly;
said right side and left side at least one rocker arms being pivotally coupled to said main beam assembly and each extending in a generally vertical direction;
said lateral piston pivotally coupled to one end of said right side at least one rocker arm and said left side at least one rocker arm;
said right side lateral rod assembly pivotally coupled to the end of said right side rocker arm opposite said lateral piston;
said left side lateral rod assembly pivotally coupled to the end of said left side at least one rocker arm opposite said lateral piston;
said right side lateral rod assembly further pivotally coupled to said right side vertical arm assembly;
said left side lateral rod assembly further pivotally coupled to said left side vertical arm assembly; and
whereby actuation of said lateral piston causes said right side pad assembly and said left side pad assembly to move in a pincer-like manner.

11. The nipper-clipper assembly of claim 10, wherein:
said right side lateral arm assembly includes at least one stand off piston;
said left side lateral arm assembly includes at least one stand off piston;
said right side lateral arm assembly stand off piston attached to said main beam assembly adjacent to said right side lateral arm assembly rocker arm and structured to extend in a lateral direction and further structured to engage said right side lateral arm assembly rocker arm and cause said right side lateral arm assembly rocker arm to pivot; and
said left side lateral arm assembly stand off piston attached to said main beam assembly adjacent to said left side lateral arm assembly rocker arm and structured to extend in a lateral direction and further structured to engage said left side lateral arm assembly rocker arm and cause said left side lateral arm assembly rocker arm to pivot.

12. The nipper-clipper assembly of claim 10, wherein:
said right side vertical arm assembly includes a lifting device structured to move said right side pad assembly vertically; and
said left side vertical arm assembly includes a lifting device structured to move said right side pad assembly vertically.

13. The nipper-clipper assembly of claim 12, wherein said lifting device is a piston.

14. The nipper-clipper assembly of claim 13, wherein:
said right side vertical arm assembly includes an elongated first member, and elongated second member, and said right side pad assembly;
said left side vertical arm assembly includes an elongated first member, and elongated second member, and said left side pad assembly;
said right side second member structured to move vertically and pivot laterally; and
said left side second member structured to move vertically and pivot laterally.

15. The nipper-clipper assembly of claim 14, wherein;
said right side first member is pivotally coupled to said main beam assembly and extending laterally therefrom;
said right side second member is pivotally coupled to the distal end of said right side first member and extending in a generally vertical direction;
said right side pad assembly is coupled to the distal end of said right side second member;
said left side first member pivotally is coupled to said main beam assembly and extending laterally therefrom;
said left side second member pivotally is coupled to the distal end of said left side first member and extending in a generally vertical direction; and
said left side pad assembly is coupled to the distal end of said left side second member.

16. The nipper-clipper assembly of claim 15, wherein:
said right side lateral rod assembly is coupled to said right side second member; and
said left side lateral rod assembly is coupled to said left side second member.

17. The nipper-clipper assembly of claim 16, wherein:
said right side vertical piston is pivotally coupled to said main beam assembly and pivotally connected to the distal end of said right side first member; and
said left side vertical piston is pivotally coupled to said main beam assembly and pivotally connected to the distal end of said left side first member.

18. The nipper-clipper assembly of claim 17, wherein:
said right side pad assembly includes a pad plate, said pad plate being pivotally coupled to said right side second member; and
said left side pad assembly includes a pad plate, said pad plate being pivotally coupled to said left side second member.

19. The nipper-clipper assembly of claim 18, wherein:
said right side clipper assembly includes a first pincer arm assembly which is pivotally coupled to said main beam assembly, a second pincer arm assembly which is pivotally coupled to said main beam assembly, and a pincer piston, which is pivotally coupled to and disposed between said right side first pincer assembly and said right side left pincer assembly; and
said left side clipper assembly includes a first pincer arm assembly which is pivotally coupled to said main beam assembly, a second pincer arm assembly which is pivotally coupled to said main beam assembly, and a pincer piston, which is pivotally coupled to and disposed between said left side first pincer assembly and said left side left pincer assembly.

20. A mobile nipper-clipper vehicle for installing clip assembly springs on rails, said clip assemblies coupled to a tie disposed below said rails, said ties extending in a lateral direction relative to said longitudinal rails, said mobile nipper-clipper vehicle comprising:
a frame;
an engine coupled to said frame;
a cab coupled to said frame;
a control panel disposed in said cab;
a plurality of rail wheels coupled to said frame;

said engine structured to drive at least one of said rail wheels;

said nipper-clipper assembly comprising:

a mounting device;

a nipper assembly that is structured to lift said ties and move said ties laterally and including a vertical lifting device that is structured to lift said ties and a lateral movement device that is structured to move said ties laterally; and one or more clipping assemblies.

21. The mobile nipper-clipper vehicle of claim 20, wherein said lateral movement device is floatably coupled to said mounting device.

22. The mobile nipper-clipper vehicle of claim 20, wherein said vertical lifting device is structured to contact the lateral ends of said tie.

23. The nipper-clipper vehicle of claim 20, wherein said nipper-clipper assembly is pivotally coupled to said frame and structured to move between a first, lower position and a second, upper position.

24. A mobile nipper-clipper vehicle for installing clip assembly springs on rails, said clip assemblies coupled to a tie disposed below said rails, said ties extending in a lateral direction relative to said longitudinal rails, said mobile nipper-clipper vehicle comprising:

a frame;

an engine coupled to said frame;

a cab coupled to said frame;

a control panel disposed in said cab;

a plurality of rail wheels coupled to said frame;

said engine structured to drive at least one of said rail wheels;

a nipper-clipper assembly comprising:

a main beam assembly;

a right side clipping assembly coupled to said main beam assembly;

a left side clipping assembly coupled to said main beam assembly;

a right side nipper assembly having a pad assembly coupled to said main beam assembly;

a left side nipper assembly having a pad assembly coupled to said main beam assembly; and said right side pad assembly and said left side pad assembly structured to act upon said tie by contacting the lateral ends of said tie.

25. The nipper-clipper vehicle of claim 24, wherein said right side nipper assembly and left side nipper assembly are structured to move said tie laterally.

26. The nipper-clipper vehicle of claim 25, wherein said right side nipper assembly and left side nipper assembly are structured to cooperate in a pincer-like movement.

27. The nipper-clipper vehicle of claim 26, wherein said nipper assembly includes:

a right side vertical arm assembly having an articulated arm that is pivotally coupled to said main beam assembly and structured to move between a first upper position and a second lower position;

a left side vertical arm assembly having an articulated arm that is pivotally coupled to said main beam assembly and structured to move between a first upper position and a second lower position;

a right side lateral arm assembly structured to move between a first, open position and a second closed position; and a left side lateral arm assembly structured to move between a first, open position and a second closed position.

28. The nipper-clipper vehicle of claim 27, wherein:

said right side lateral arm assembly and said left side lateral arm assembly share a lateral piston; and said lateral piston floatably coupled to said main beam assembly.

29. The nipper-clipper vehicle of claim 28, wherein:

said nipper assembly includes one or more rocker arms;

said one or more rocker arms pivotally coupled to said main beam assembly; and said lateral piston is pivotally coupled one or more rocker arms.

30. The nipper-clipper vehicle of claim 29, wherein:

said right side lateral arm assembly includes at least one rocker arm, and at least one lateral rod assembly;

said left side lateral arm assembly includes at least one rocker arm, and at least one lateral rod assembly;

said right side and left side at least one rocker arms being pivotally coupled to said main beam assembly and each extending in a generally vertical direction;

said lateral piston pivotally coupled to one end of said right side at least one rocker arm and said left side at least one rocker arm;

said right side lateral rod assembly pivotally coupled to the end of said right side rocker arm opposite said lateral piston;

said left side lateral rod assembly pivotally coupled to the end of said left side at least one rocker arm opposite said lateral piston;

said right side lateral rod assembly further pivotally coupled to said right side vertical arm assembly;

said left side lateral rod assembly further pivotally coupled to said left side vertical arm assembly; and whereby actuation of said lateral piston causes said right side pad assembly and said left side pad assembly to move in a pincer-like manner.

31. The nipper-clipper vehicle of claim 29, wherein:

said right side lateral arm assembly includes at least one stand off piston;

said left side lateral arm assembly includes at least one stand off piston; and each said stand off piston attached to said main beam assembly adjacent to a rocker arm and structured to extend in a lateral direction and further structured to engage a rocker arm and cause said rocker arm to pivot.

32. The nipper-clipper vehicle of claim 29, wherein:

said right side vertical arm assembly includes a lifting device structured to move said right side pad assembly vertically; and said left side vertical arm assembly includes a lifting device structured to move said right side pad assembly vertically.

33. The nipper-clipper vehicle of claim 32, wherein said lifting device is a piston.

34. The nipper-clipper vehicle of claim 33, wherein:

said right side vertical arm assembly includes an elongated first member, and elongated second member, and said right side pad assembly;

said left side vertical arm assembly includes an elongated first member, and elongated second member, and said left side pad assembly;

said right side second member structured to move vertically and pivot laterally; and said left side second member structured to move vertically and pivot laterally.

35. The nipper-clipper vehicle of claim 34, wherein:

said right side first member is pivotally coupled to said main beam assembly and extending laterally therefrom;

said right side second member is pivotally coupled to the distal end of said right side first member and extending in a generally vertical direction;

said right side pad assembly is coupled to the distal end of said right side second member;

said left side first member pivotally is coupled to said main beam assembly and extending laterally therefrom;

said left side second member pivotally is coupled to the distal end of said left side first member and extending in a generally vertical direction; and said left side pad assembly is coupled to the distal end of said left side second member.

36. The nipper-clipper vehicle of claim 35, wherein:

said right side lateral rod assembly is coupled to said right side second member; and said left side lateral rod assembly is coupled to said left side second member.

37. The nipper-clipper vehicle of claim 36 wherein:

said right side vertical piston is pivotally coupled to said main beam assembly and pivotally connected to the distal end of said right side first member; and said left side vertical piston is pivotally coupled to said main beam assembly and pivotally connected to the distal end of said left side first member.

38. The nipper-clipper vehicle of claim 37, herein:

said right side pad assembly includes a pad plate, said pad plate being pivotally coupled to said right side second member; and said left side pad assembly includes a pad plate, said pad plate being pivotally coupled to said left side second member.

39. The nipper-clipper vehicle of claim 38, wherein:

said right side clipper assembly includes a first pincer arm assembly which is pivotally coupled to said main beam assembly, a second pincer arm assembly which is pivotally coupled to said main beam assembly, and a pincer piston, which is pivotally coupled to and disposed between said right side first pincer assembly and said right side left pincer assembly; and said left side clipper assembly includes a first pincer arm assembly which is pivotally coupled to said main beam assembly, a second pincer arm assembly which is pivotally coupled to said main beam assembly, and a pincer piston, which is pivotally coupled to and disposed between said left side first pincer assembly and said left side left pincer assembly.

40. A method of operating a nipper-clipper vehicle to install springs on railroad clip assemblies to secure rails to ties, said method comprising the steps of:

a) providing a nipper-clipper vehicle having a frame, an engine coupled to said frame, a cab coupled to said frame, a control panel disposed in said cab, a plurality of rail wheels coupled to said frame, said engine structured to drive at least one of said rail wheels, a nipper-clipper assembly pivotally coupled to said frame and structured to move between a first, lower position and a second, upper position, said nipper-clipper assembly having a main beam assembly, a right side clipping assembly, a left side rail clipping assembly, a right side nipper assembly having a pad assembly, a left side nipper assembly having a pad assembly; and, wherein said right side pad assembly and said left side pad assembly structured to act upon said tie by contacting the lateral ends of said tie;

b) positioning said nipper-clipper vehicle on a railroad track having one or more uninstalled springs on one or more railroad clip assemblies, where one or more ties are misaligned and spaced from the bottom of the rails;

c) positioning said nipper-clipper vehicle so that said nipper-clipper assembly is disposed above said misaligned tie;

d) holding said tie between said right side nipper assembly and said left side nipper assembly;

e) lifting said tie into contact with said rails; and f) utilizing said right side clipper assembly and said left side clipper assembly to install said springs.

41. The method of claim 40, wherein said nipper-clipper assembly includes a right side vertical arm assembly pivotally coupled to said main beam assembly and structured to move between a first upper position and a second lower position and having a laterally pivotable second member, a left side vertical arm assembly pivotally coupled to said main beam assembly and structured to move between a first upper position and a second lower position and having a laterally pivotable second member, a right side lateral arm assembly pivotally coupled to said main beam assembly and pivotally coupled to right side second member and structured to move said right side second member between a first, open position and a second closed position, and a left side lateral arm assembly pivotally coupled to said main beam assembly and pivotally coupled to right side second member and structured to move said right side second member between a first, open position and a second closed position, and wherein said step of lifting said tie further comprises the step of:

a) allowing gravity to center said tie under said rails.

42. The method of claim 40, wherein said nipper-clipper assembly includes a right side vertical arm assembly pivotally coupled to said main beam assembly and structured to move between a first upper position and a second lower position and having a laterally pivotable second member, a left side vertical arm assembly pivotally coupled to said main beam assembly and structured to move between a first upper position and a second lower position and having a laterally pivotable second member, a right side lateral arm assembly pivotally coupled to said main beam assembly and pivotally coupled to right side second member and structured to move said right side second member between a first, open position and a second closed position, and a left side lateral arm assembly pivotally coupled to said main beam assembly and pivotally coupled to right side second member and structured to move said right side second member between a first, open position and a second closed position, said right side lateral arm assembly and said left side lateral arm assembly each coupled to a single floating lateral piston, said lateral piston floatably coupled to said main beam assembly by two or more rocker arms, said right side lateral arm assembly and said left side lateral arm assembly each further including a stand off piston coupled to said main beam assembly adjacent to a rocker arm, said stand off piston structured to extend laterally and engage said one rocker arm, and wherein said step of lifting said tie further comprises the step of:

a) actuating at least one stand off piston until said stand off piston engages one said rocker arm, causing said rocker arm to pivot, thereby causing said right side lateral arm assembly and said left side lateral arm assembly to move laterally until said tie is centered under said rails.

* * * * *